United States Patent [19]

Christianson et al.

[11] Patent Number: 4,706,646

[45] Date of Patent: Nov. 17, 1987

[54] TOTAL COUNTERFLOW HEAT EXCHANGER

[75] Inventors: Paul O. Christianson, Glenburn; James M. McDonald, Minot, both of N. Dak.

[73] Assignee: M.A.C., Inc., Glenburn, N. Dak.

[21] Appl. No.: 844,850

[22] Filed: Mar. 27, 1986

[51] Int. Cl.[4] ..... F24H 3/12

[52] U.S. Cl. ..... 126/117; 126/99 C; 126/99 D; 126/106; 126/109; 165/160

[58] Field of Search ..... 126/117, 109, 99 R, 126/99 A, 99 C, 99 D, 106, 108, 110 R, 114; 165/160

[56] References Cited

U.S. PATENT DOCUMENTS

| | | | |
|---|---|---|---|
| 99,573 | 2/1870 | Johnson | 165/160 |
| 298,202 | 5/1884 | Hayes | 165/160 |
| 1,672,650 | 6/1928 | Lonsdale | 165/160 |
| 1,683,236 | 9/1928 | Braun | 165/160 |
| 3,183,969 | 5/1965 | Bell | 165/160 |

FOREIGN PATENT DOCUMENTS

| | | | |
|---|---|---|---|
| 882095 | 5/1953 | Fed. Rep. of Germany | 165/160 |

*Primary Examiner*—James C. Yeung

*Attorney, Agent, or Firm*—Moore & Hansen

[57] ABSTRACT

A total counterflow heat exchanger comprising a system of partitions dividing an interior chamber into a series of channels which coincide with the path of a duct through that interior chamber. A substance at one temperature is passed through the duct, and a substance at a second temperature is passed through the channels, thereby creating a temperature differential gradient over which thermal energy is transfered from one substance to the other as the substances flow through the heat exchanger. The arrangement of the partitions permits a substance to pass back and forth through the channels in the heat exchanger along the same path as the duct, so that while the substance may flow through the heat exchanger at the same net rate as if the partitions were not present, the length of the heat exchange gradient may be increased many times, therefore enhancing the efficiency of the gradient and the heat exchanger. The particular design of this invention also permits simplified construction and servicing of an indirect fired heat exchanger, greater freedom in positioning inlet and exhaust ports, and adaptability to many diverse applications by combining a variety of different partition placements and numbers.

30 Claims, 10 Drawing Figures

TOTAL COUNTERFLOW HEAT EXCHANGER

BACKGROUND OF THE INVENTION

Heat exchangers for gases and liquids—particularly counterflow heat exchangers—have long been known and used for a variety of purposes. Some of the notable applications have included: placing a heat exchanger on a building's exhaust outlet so that heated exhaust air which normally must be vented from a building may be used to preheat incoming fresh air to minimize the energy needed to heat that incoming air to a desired temperature, use in commercial water heaters, attachments for stove and furnace flues, and many industrial chemical engineering processes.

The principles of heat transfer dictate that as two fluids (liquids or gases) at different temperatures are passed through a heat exchanger, a differential temperature gradient will be established and each fluid will tend to approach (but not reach) an equilibrium temperature. That equilibrium temperature is a function of the density and molecular structure of each fluid, the coefficient of heat transfer within the exchange gradient, the ratio of the total volume of each fluid to the surface area of the exchange gradient, and the length of time that each fluid is in contact with the transfer gradient.

In most applications, the fluids used in the heat exchanger are controlled by the function of that heat exchanger—usually ambient and exhaust air, or water. The coefficient of heat transfer for the gradient is a physical property of the material used, which is again dictated by the function of the heat exchanger, as well as economic considerations and the available manufacturing methods. Sheet metal, ductwork, metal pipe or firewall tubing, and glass are commonly used materials.

While the total volume of each fluid within a given heat exchanger and the surface area of the gradient are somewhat within the designer's control, there again are economic and practical constraints limiting the total size of the heat exchange apparatus and the surface area of the exchange gradient. Often, piping must be of a particular minimum diameter or wall thickness so as not to impede the flow of fluids through the heat exchanger, or to comply with local safety and construction standards, and the total volume of the heat exchanger is limited by the area in which it will eventually be used.

Furthermore, a heat exchanger designer faces the theoretical task of balancing the reciprocal relation between the cross-sectional size of the channels which carry each fluid and the resulting speed at which that fluid will travel through the channel according to Bernoulli's equation. Decreasing the cross-section of a channel so that a greater length of channel may be placed within a heat exchanger (to increase the surface area of the gradient or lengthen the time that the fluid flows within the exchanger) has a detrimental effect of increasing the flow rate for that fluid and decreasing the time which that fluid is in contact with the gradient, thus reducing the efficiency of the heat exchanger.

Solutions to maximize the heat exchange characteristics are the subject of a variety of multiple linear differential equations relating each variable, such as the volume or temperature of each fluid, the surface area and coefficient of heat transfer of the gradient, and the length of time each fluid is in contact with the gradient.

Because these relationships are generally linear, one result reached is that the temperature of the transfer gradient at any one point can achieve equilibrium (assuming a relatively constant flow rate for each fluid) although the fluids themselves do not reach thermal equilibrium. Consequently, within the confines of the physical dimensions for a particular unit volume heat exchanger and its component channels, it is a general rule that increasing the longitudinal path for each substance along the transfer gradient will increase the efficiency of that gradient, and have the greatest effect on bringing the total volume of each substance closer to a higher thermal equilibrium, thereby also increasing the efficiency of the heat exchanger. Distinquishing the efficiency of the gradient from the efficiency of the heat exchanger itself is one key to recognizing why the heat exchanger of this invention can achieve such a drastic overall increase in heating efficiency.

When the aim of the heat exchanger is to transfer the maximum amount of thermal energy in one direction, the general rule will apply so long as the flow rate of the fluid to be heated is not increased to a point where the total time during which the total volume of that fluid is in contact with the heat exchange gradient is diminished.

As such, one problem facing heat exchanger designers has been to find a configuration which increases the longitudinal path of each fluid along the transfer gradient without unduly decreasing the time each fluid contacts that transfer gradient.

A second problem facing the designer is to guarantee that each fluid (particularly that to be heated) is thoroughly agitated as it passes through the heat exchanger, to ensure complete and uniform distribution of the thermal energy. Convection layers or isothermal pockets (small volumes of fluid closer to the equilibrium temperature) create insulating barriers between the gradient and the bulk of the fluid which reduce the effectiveness of the transfer gradient. While it is important to mix each fluid to prevent this insulating effect, any interference with the normal flow of the fluid will increase the static pressure and energy required to move that fluid through the heat exchanger, a factor which must be weighed to prevent undermining the overall efficiency of the heat exchanger.

Recognition of these principles led to the design of the counterflow heat exchanger, wherein one of the fluids is chahneled back and forth within the confines of the heat exchanger to maximize the amount of thermal energy that was transfered. Various counterflow heat exchange designs have long been practiced, the most effective and efficient exchangers placing fluids of higher temperatures within a tube surrounded by the substance to be heated, so that any heat escaping from the hot source is captured by the cold sink. While the theory behind counterflow heat exchangers has been thoroughly refined and taught to a great extent, relatively little improvement in the actual development of commercial heat exchanger designs has been seen.

One limitation found in existing configurations is that the fluid being heated makes only a single pass through, rather than flowing back and forth within, the heat exchanger.

The total counterflow heat exchanger disclosed herein recognizes this inadequacy and presents a means to pass each fluid back and forth throughout the entire heat exchange cavity by using a system of partitions surrounding an interior channel. While the total time each substance remains in the heat exchanger remains constant (because the velocity-area product remains constant for an incompressible fluid) the longitudinal path of the fluid to be heated along the transfer gradient may be increased more than threefold. Thus, a more efficient heat transfer gradient may be created over the length of the heat exchanger, thus raising the equilibrium temperature and therefore the quantum of thermal energy that is transfered to and circulated within the fluid being heated. This increases the efficiency per unit volume of the overall heat exchanger.

The total counterflow heat exchanger of this invention also enhances the even and thorough mixing of the outer fluid that is to be heated. By passing the substance back and forth within the channel, greater turbulence is produced. The increase in static pressure also increases the thermal energy of the fluid, but the longitudinal rather than lateral positioning of the partitions does not unduly impede the flow of the fluid through the interior chamber.

One might attempt to produce a total counterflow heat exchanger by spatially situating a linear tube inside a larger linear channel of equal length, and then folding those over into a counterflow arrangement within the heat exchanger cavity. However, construction of such an exchanger would present significant manufacturing problems, as well as consuming more raw materials than would make such a heat exchanger economically practical.

Furthermore, in situations where a combustion source is placed within or in conjunction with the inner tube of a heat exchanger (creating an indirect fired heat exchanger that also uses the inner tube as an exhaust stack) the construction of a tube within a reciprocal channel makes access to the combustion source for servicing or fueling very difficult.

The total counterflow heat exchanger of this invention overcomes each of these drawbacks while permitting the reciprocal flow of both fluids within the confines of the heat exchanger by employing longitudinal partitions. These partitions may be inserted in varying combinations within the cavity of the heat exchanger after the interior channel has been constructed and is in place. Access to a combustion chamber may be accomplished via a single passageway. In liquid applications, where a great multiplicity of complex channels is contemplated, the use of partitions permits far easier construction since the partitions may be inserted after the interior tubes have been constructed and positioned, rather than attempting to work with several interlocking and encapsulated channels simultaneously. Finally, because of the increased efficiency of this total counterflow heat exchanger, units with a desired thermal output may be constructed to fit into spaces where they once could not, or less fuel need be used to achieve that thermal output than was previously required.

BRIEF SUMMARY OF THE INVENTION

The total counterflow heat exchanger of this invention is particularly characterized by a shell encompassing an interior chamber, and an arrangement of partitions extending inwardly from the shell and longitudinally through the interior chamber. The shell also surrounds a serpentine tube which runs back and forth within the interior chamber and communicates with the exterior of the heat exchanger in two places. The partitions are constructed and arranged to divide the interior chamber into subchambers defining a continuous channel which coincides with the path of the serpentine tube through the interior chamber, and this channel similarly communicates with the exterior of the heat exchanger.

In operation, a first fluid at a first temperature may be passed through the tube, and a second fluid at a second temperature may be passed through the channel of the interior chamber, thereby creating a temperature differential gradient allowing the transfer of thermal energy between the two fluids.

In the most common application, the first fluid will be heated exhaust air, and the second fluid will be cooler ambient or incoming fresh air to be preheated as it passes through the heat exchanger. The tube will contain a combustion chamber region to enclose a heating coil or burner to heat the exhaust air, with the tube acting as a chimney. The entire heat exchanger will be enclosed in a housing and equipped with blower fans to draw the ambient or incoming fresh air into the housing, blow it through the channel in the interior chamber around the heated tube, and then expel that air back into the building. A system using a cylindrical shell and interior chamber is ideally envisioned, with three partitions connected to the shell along their outer longitudinal edges and extending radially inward and joined together near the central axis of the interior chamber, serving to control the flow of the air through the channel. By using this system, the length of the transfer gradient may be tripled (when compared to previous heat exchanger designs), thereby greatly increasing the efficiency of the heat exchanger.

The total counterflow heat exchanger may also be modified to contain a multiplicity of partitions and corresponding folds in the tube, thus increasing the longitudinal path of each fluid passing through the heat exchanger and the length of the heat transfer gradient. This embodiment is particularly well suited for use in liquid filled heat exchangers and chemical engineering processes.

The positioning of the partitions may be altered to permit the channel to communicate with the exterior of the heat exchanger in an unlimited combination of arrangements. These partitions may be installed after the serpentine tube is in place, thus greatly enhancing the ease in manufacturing the total counterflow heat exchanger of this invention.

The configuration of the partitions and tube also allows access to the combustion chamber through a single passageway.

DESCRIPTION OF THE PREFERRED EMBODIMENTS

Figure 1:
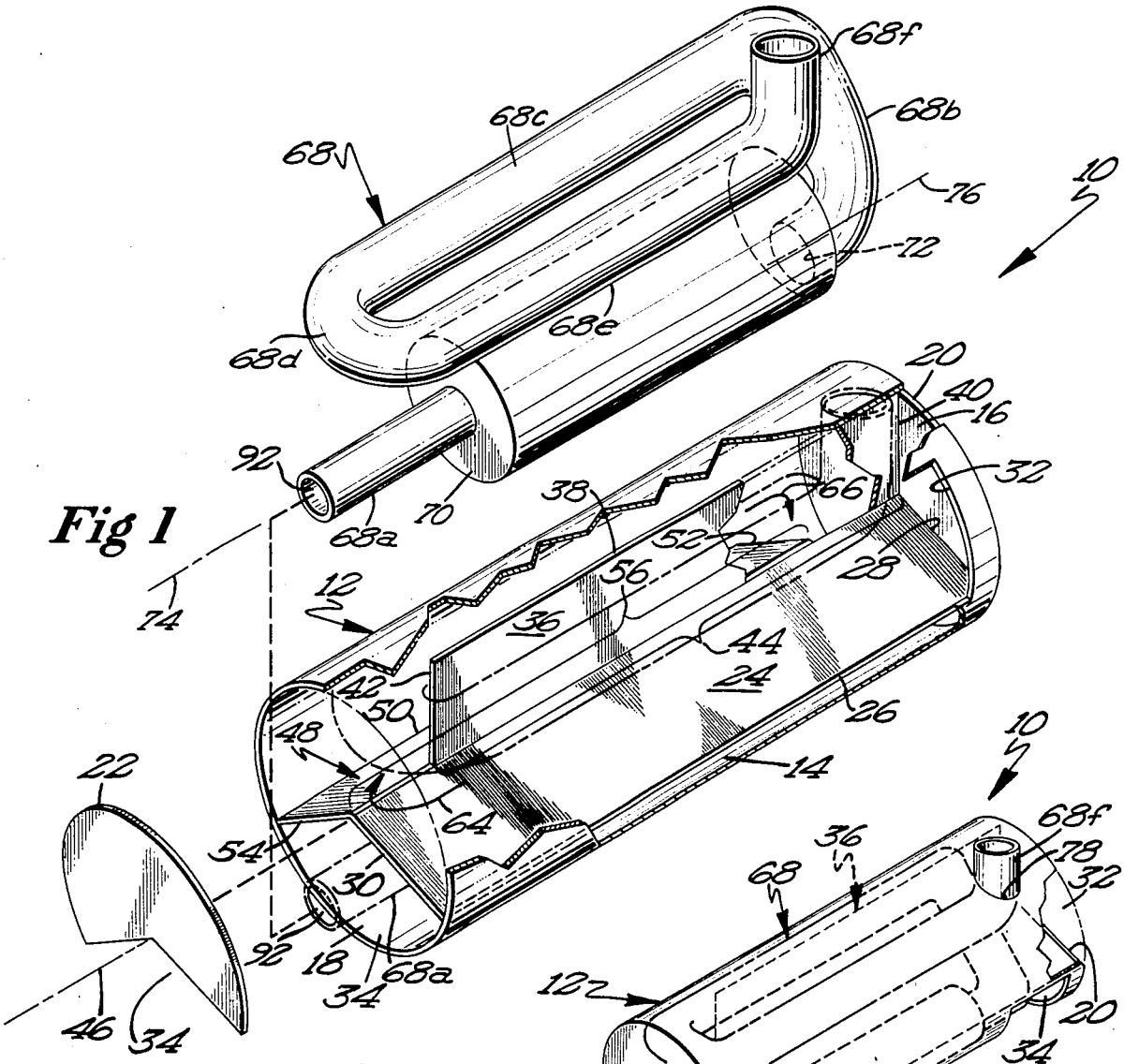
FIG. 1 is an exploded perspective view of the total counterflow heat exchanger.

The total counterflow heat exchanger of this invention is a shell and tube type heat exchanger, shown in FIGS. 1–10 and referenced generally by numeral 10.

The particular embodiment of the heat exchanger which has been depicted in FIGS. 1–5 contains a shell 12 with a generally circular cross section which defines and surrounds a generally cylindrical interior chamber 14 open at each end 16, 18. First and second end caps 20, 22 which further enclose the interior chamber 14 are connected to the shell 12 at the ends 16, 18.

A first partition 24 is attached along the length of its outer longitudinal edge 26 of the shell 12, and is attached along each end edge 28, 30 to the end caps 20, 22 adjacent a first portal opening 32 in the first end cap 20 and a second portal opening 34 in the second end cap 22.

A second partition 36 is attached along the length of its outer longitudinal edge 38 to the shell 12 and to end cap 20 along its end edge 40 adjacent the first portal opening 32 opposite the first partition 24. The second partition 36 extends through the interior chamber 14 and terminates along end edge 42 within that interior chamber 14. The first and second partitions 24, 36 extend radially inward from the shell 12 and are attached along an overlapping and coterminous segment 44 near the center of the interior chamber 46.

A third partition 48 is attached along its outer longitudinal edge 50 to the shell 12, and to end cap 22 along its end edge. The third partition 48 extends radially inward from the shell 12 and is joined to the first or second partitions 24, 36 along an overlapping and coterminous segment 56 in the center of the interior chamber 46. The partitions 24, 36, 48 divide the interior chamber into a first, second, and third subchamber 58, 60, 62 respectively, with passages 64, 66 leading between the subchambers 58, 60, 62. The subchambers 58, 60, 62 and passages 64, 66 combine to form a channel 100 leading through the heat exchanger 10.

A serpentine tube 68 extends from the first subchamber 58 through the successive passages and subchamber 64, 60, 66 to a point in the third subchamber 62 adjacent the second portal opening 34. The serpentine tube is constructed from a series of straight **68*a*, 68*c*, 68*e* and U-bend 68*b*, 68*d*, and partial U-bend 68*f* tubular sections. The serpentine tube 68 contains a portion which constitutes a combustion chamber region 70 which has a radially diameter greater than the adjoining serpentine tube 68. At the point where the serpentine tube is connected to the combustion chamber region 72, the radial axis of the combustion chamber 74 is spatially displaced from the radial axis of the serpentine tube 76 so as to make the outer surfaces of the serpentine tube 68 and combustion chamber region 70 somewhat tangential. The shell 12 further contains a chimney port 78 through which the serpentine tube 68 extends from the first subchamber 58**.

Figure 2:
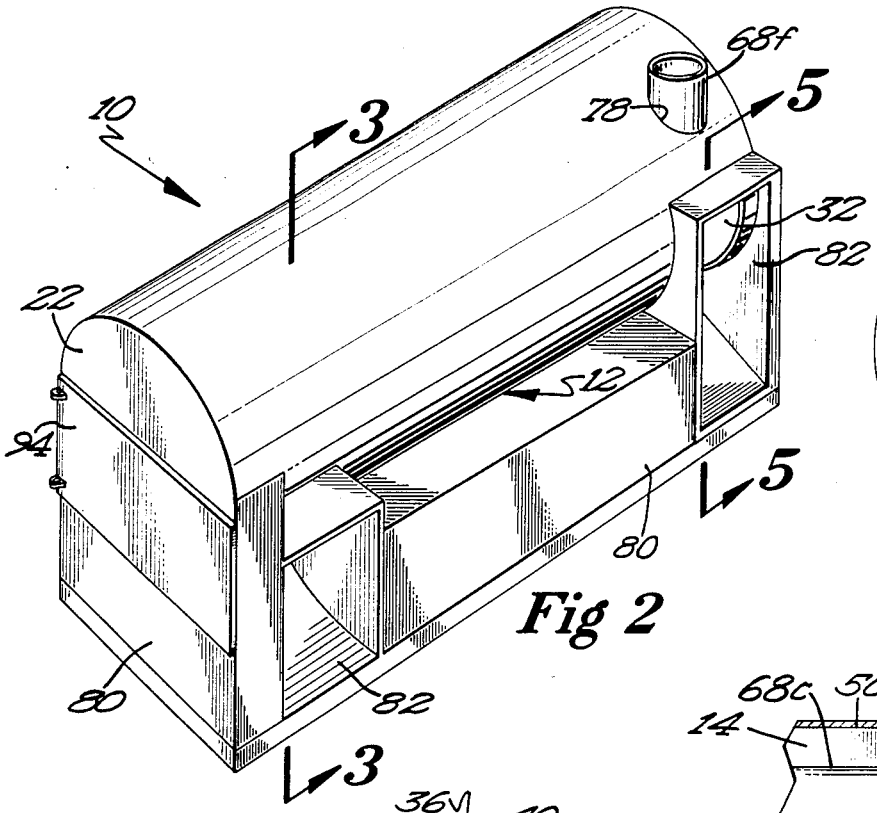
FIG. 2 is a perspective view of the heat exchanger mounted in its housing.
Figure 8:
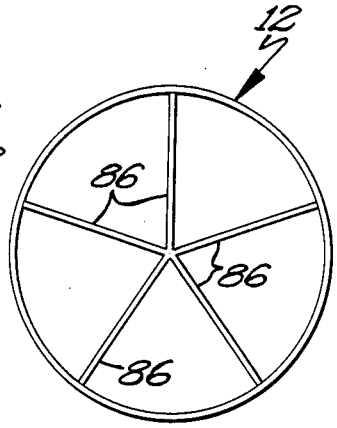
FIG. 8 is a cross-sectional view displaying the geometric placement of five partitions within a cylindrical shell.
Figure 10:
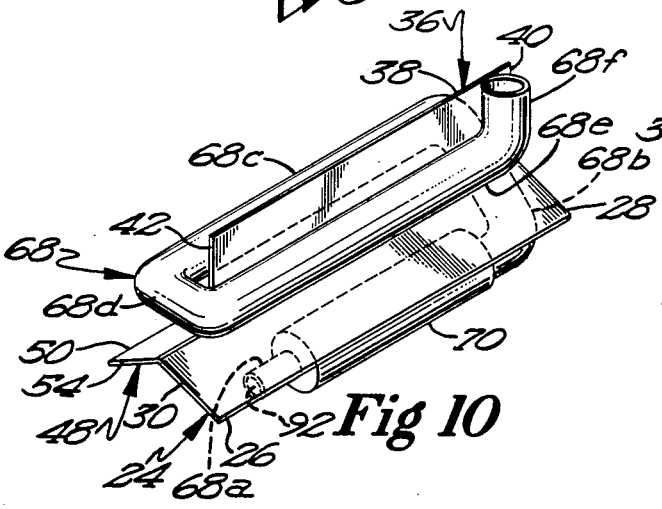
FIG. 10 is a perspective view of the partitions and serpentine tube of the heat exchanger separated from the shell.
Figure 4:
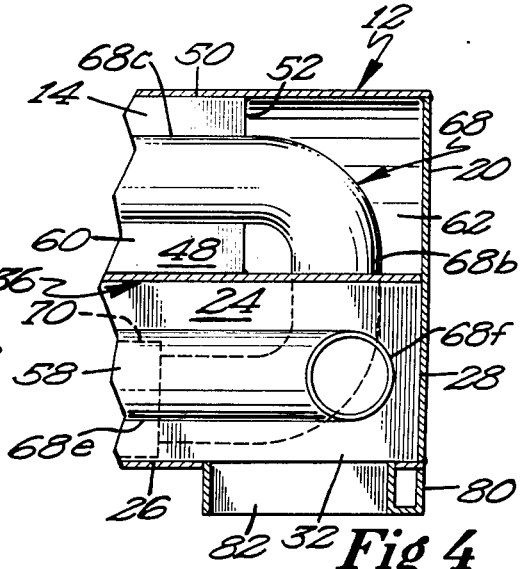
FIG. 4 is a cross-sectional view from the top of the right side of the heat exchanger taken through line 4—4 in FIG. 3, showing the position of the serpentine tube in partial phantom.
Figure 9:
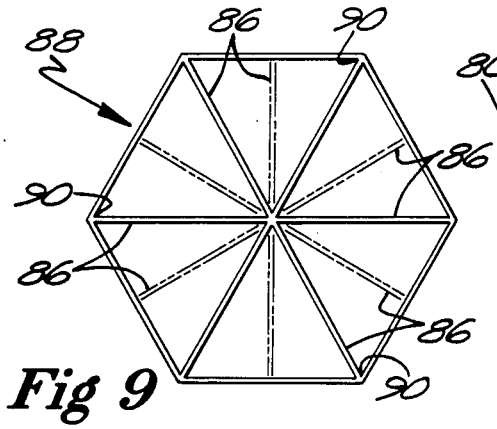
FIG. 9 is a cross-sectional view displaying the alternate geometric placement of six partitions within a regular polygonal shell, with the partitions attached to the corners of the shell in phantom.
Figure 5:
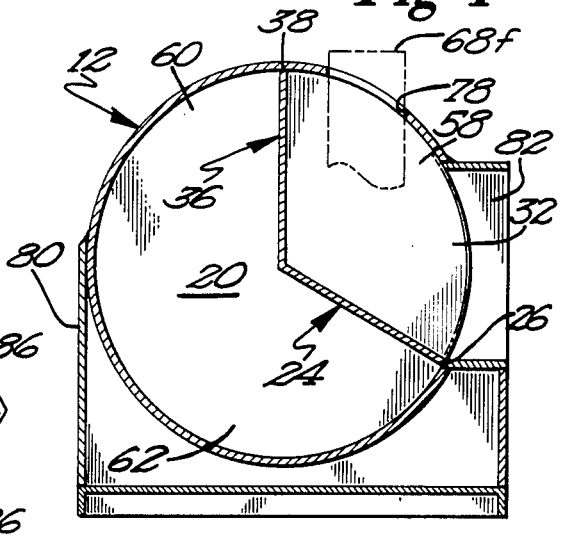
FIG. 5 is a cross-sectional view of the heat exchanger mounted in its housing taken through line 5—5 in FIG. 4.

In operation as an indirect fired air heater, the total counterflow heat exchanger 10 may be placed inside a housing 80 which has housing portals 82 situated to communicate with the first and second portal openings 32, 34 of the heat exchanger 10 as shown in FIG. 2. Commercially available blower fans may be located within the housing 80 from the exterior room 84, circulate it through the heat exchanger 10, and return the heated air to the exterior room 84.

One of many known petroleum fueled or electric heating elements may be positioned within the combustion chamber 70. If a fuel burning source is used, exhaust fumes and gases are vented through the serpentine tube 68 and chimney port 78, which may be connected to an outside exhaust system. The burner element and combustion chamber region 70 may be reached via a hinged access panel 96.

For many applications, it is more practical to place the combustion burner or heating element outside the heat exchanger 10, and have only the burner nozzle extending into the combustion chamber region 70 through the mouth serpentine tube 68.

The total counterflow heat exchanger may also be equipped with sensing devices of a type currently in use to warn of perforations and leaks in the partitions 24, 36, 48, combustion chamber region 70, or serpentine tube 68 to prevent fuel or exhaust fumes from escaping into the exterior room 84, or a loss of heat.

In other applications, several modifications in the design of the total counterflow heat exchanger 10 have been contemplated.

Figure 7:
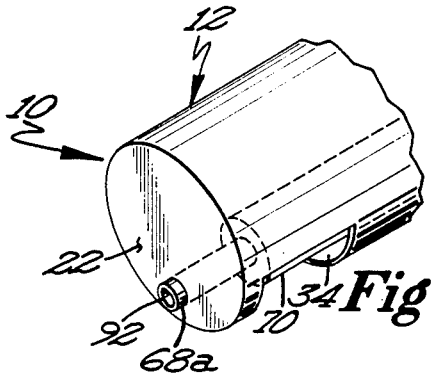
FIG. 7 is a perspective view of the left side of an embodiment of the heat exchanger wherein the left end cap defines a portal the same size as the tube.

The second portal opening 34 in the second end cap 22 may be replaced by a portal opening 96 anywhere along the shell 12 adjacent the third subchamber 62. The first portal opening 32 may similarly be placed along the shell 12 adjacent the first subchamber 58. One such configuration is shown in FIGS. 1 and 7.

The second end cap 22 may define a portal opening 34 just large enough to allow a burner nozzle to access the combustion chamber region 70 through the serpentine tube 68. (As in FIG. 7) The first portal opening 32 may then be enlarged to communicate with both the first and third subchambers 58, 62 and an additional partition 98 is added to divide the third subchamber 62. This fourth partition 98 need only extend from the first end cap 20 to the combustion chamber region 70 if the combustion chamber region 70 is centered in the third subchamber 62.

Figure 6:
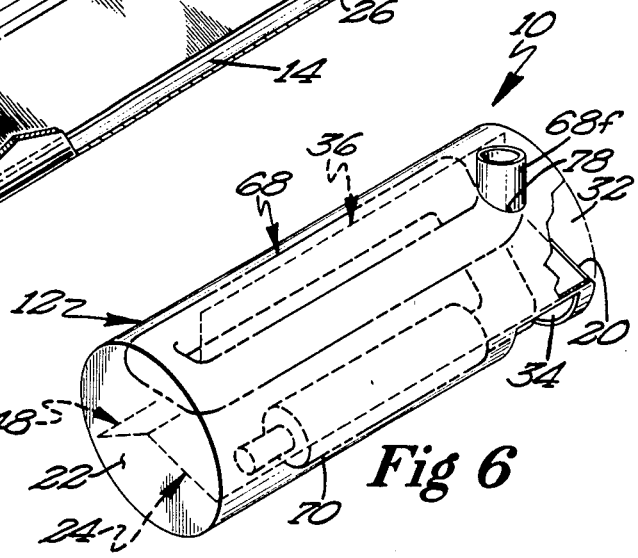
FIG. 6 is a perspective view of the partitions and serpentine tube in phantom within an embodiment of the heat exchanger wherein the end of the tube is entirely enclosed in the interior chamber.
Figure 3:
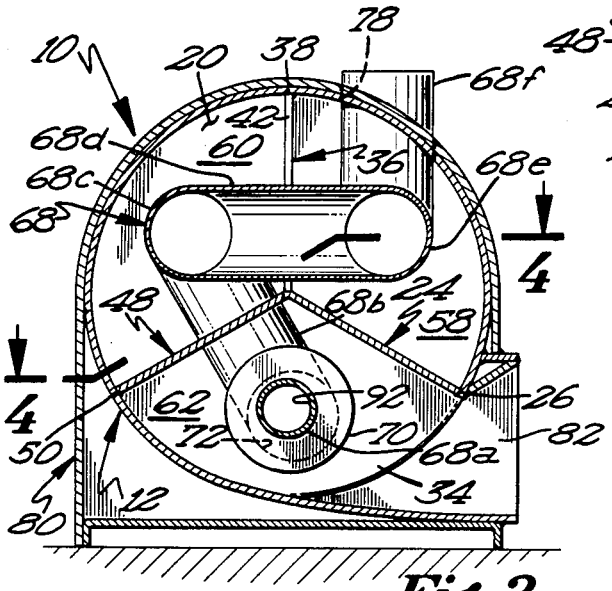
FIG. 3 is a cross-sectional view from the left side of the heat exchanger taken through line 3—3 in FIG. 2, showing the serpentine tube in partial phantom.

If the heating element will be entirely enclosed in the combustion chamber 70, a closed-feed system may be created by sealing off the second portal opening 34, and placing the mouth of the serpentine tube 92 well inside the third subchamber 62 so that a portion of the incoming air is used to supply the combustion chamber 70 and is exhausted through the serpentine tube 68. This system is shown in FIG. 6.

The number of partitions 86 within the interior chamber 14 may be increased from three to four, five, six, and so forth, depending upon the length of the gradient and amount of turbulence that is desired, and the degree of static pressure that may be tolerated. These partitions 86 may be organized geometrically within a cylindrical shell 12 (as in FIG. 8) or within a shell 88 whose cross section is a regular polygon having the same number of sides as there are partitions 86, the partitions 86 being connected to the shell 12 at or between the shell corners 90 (as in FIG. 9).

In situations where manufacturing costs are inconsequential when compared to the peak operating efficiency of heat exchanger 10, the size of each partition 24, 36, 48, the volume of each subchamber 58, 60, 62, and the diameter of the serpentine tube 68 may be altered to achieve an ascending or descending order of cross-sections to regulate the flow rate through the channel 100 as a function of the temperature of the gradient at any one point, so as to maximize the absolute efficiency of the exchanger 10. The serpentine tube 68 may also be attached to the partitions 86 so they will act as heat conductors or extensions of the transfer gradient.

Using the total counterflow heat exchanger as an indirect fired air heater, it is understood that a degree of fireproofing or insulation commensurate with the system's heat output would be necessary. It is also contemplated that heavier gauged materials would be employed than would be required in the absence of a combustion chamber 70. In a situation where lighter gauged sheet metal could be used, it is contemplated that the serpentine tube 68 could be formed from flat sections of sheeting, two sections of sheeting, two sections fastened at acute angles between each of the partitions 86, with the space between the sheets acting as a duct. By extending these sections to the end caps 20, 22, and leaving a gap between the end caps 20, 22 and the partitions 86, a continuous tube 68 would be formed within the channel 100.

What is claimed is:

1. A total counterflow heat exchanger comprising:

a shell of generally cylindrical shape open at a first end and a second end, said shell having a surface and defining a three dimensional interior chamber having a generally cylindrical periphery, with said shell further defining a first portal and a second portal extending through said surface of said shell;

a first end cap at the first end of the interior chamber, said first end cap extending substantially radially inward from the periphery of the interior chamber generally perpendicular to the surface of the cylindrical portion of the shell and connected thereto;

a second end cap at the second end of the interior chamber opposing the first end cap, said second end cap extending substantially radially inward from the periphery of the interior chamber generally perpendicular to the surface of the cylindrical portion of the shell and connected thereto, the second end cap defining a duct portal extending through the surface of the second end cap;

a first partition having a first end edge, an opposing second end edge, and an outer longitudinal edge, said first partition extending substantially radially inward from the shell and connected thereto along said outer longitudinal edge of said first partition, and extending substantially perpendicular to the first end cap and connected thereto along said first end edge of said first partition adjacent the first portal, said first partition extending longitudinally through the interior chamber and connected to the second end cap along said opposing second end edge of said first partition;

a second partition having a first end edge, an opposing second end edge, an outer longitudinal edge, and an opposing inner longitudinal edge, said second partition extending substantially radially inward from the shell and connected thereto along said outer longitudinal edge of said second partition, and extending substantially perpendicular to the first end cap and connected thereto along said first end edge of said second partition adjacent the first portal, said inner longitudinal edge of said second partition connected to a coextensive and coterminous segment of the first partition, said second partition extending longitudinally through the interior chamber and terminating therein, with the first and second partitions, the shell, the second end cap, and the first portal encompassing a first subchamber and a first passage;

a third partition having a first end edge, an opposing second end edge, an outer longitudinal edge and an opposing inner longitudinal edge, said third partition extending substantially radially inward from the shell and connected thereto along said outer longitudinal edge of said third partition and extending substantially perpendicular to the second end cap and connected thereto along said first end edge of said third partition, said inner longitudinal edge of said third partition connected to a coextensive and coterminous segment of the first partition, said third partition extending longitudinally through the interior chamber and terminating therein, with the second and third partitions, the shell, and the first and second end caps encompassing a second subchamber and a second passage, and with the third and first partitions, the shell, the second portal, the first and second end caps, and the duct portal encompassing a third subchamber, the subchambers and passages situated in fluid communication to form a serpentine channel; and a serpentine tube spatially situated within and extending through the serpentine channel, said serpentine tube connected in fluid communication with said duct portal, and said serpentine tube having at least one elongated segment extending within each of the subchambers, whereby a primary fluid at a first temperature may be passed through the serpentine channel and a secondary fluid at a second temperature may be passed through the serpentine tube, thereby creating a temperature differential gradient with the temperature of each fluid approaching thermal equilibrium across the gradient as the fluids are passed through the heat exchanger.

2. The total counterflow heat exchanger of claim 1 wherein the volume of said first subchamber, second subchamber, and third subchamber surrounding said serpentine tube differ.

3. The total counterflow heat exchanger of claim 2 wherein said shell further defines a chimney portal extending through the surface of said shell, with one end of said serpentine tube attached to said shell adjacent to and in fluid communication with said chimney portal.

4. The total counterflow heat exchanger of claim 3 wherein said serpentine tube further defines a combustion chamber region, said combustion chamber region being of generally greater cross sectional diameter than the adjacent region of said serpentine tube communicating with said combustion chamber region.

5. The total counterflow heat exchanger of claim 4 wherein the radial axis of combustion chamber spatially displaced from the radially axis of the adjacent region of said serpentine tube communicating with said combustion chamber region.

6. The total counterflow heat exchanger of claim 5 wherein said fluids are air and further comprising:

means within said combustion chamber to heat said air;

one or more means to circulate said air within said interior chamber and said serpentine tube; and a housing, situated outside said interior chamber and surrounding said first and second portals, said housing defining at least one housing portal extending through the surface of said housing.

7. A total counterflow heat exchanger comprising:

a shell of generally cylindrical shape open at a first end and a second end, said shell having a surface and defining a three dimensional interior chamber having a generally cylindrical periphery;

a first end cap at the first end of the interior chamber, said first end cap defining a first portal extending through said second end cap, and with said first end cap extending substantially radially inward from the periphery of the interior chamber generally perpendicular to the surface of the cylindrical portion of the shell and connected thereto;

a second end cap at the second end of the interior chamber opposing the first end cap, said second end cap defining a second portal extending through said second end cap, and with said second end cap extending substantially radially inward from the periphery of the interior chamber generally perpendicular to the surface of the cylindrical portion of the shell and connected thereto;

a first partition having a first end edge, an opposing second end edge, and an outer longitudinal edge, said first partition extending substantially radially inward the said shell and connected thereto along said outer longitudinal edge of said first partition, and extending substantially perpendicular to the first end cap and connected thereto along said first end edge of said first partition adjacent the first portal, said first partition extending longitudinally through the interior chamber and connected to the second end cap along said opposing second end edge of said first partition;

a second partition having a first end edge, an opposing second end edge, an outer longitudinal edge, and an opposing inner longitudinal edge, said second partition extending substantially radially inward from the shell and connected thereto along said outer longitudinal edge of said second partition, and extending substantially perpendicular to the first end cap and connected thereto along said first end edge of said second partition adjacent the first portal, said inner longitudinal edge of said second partition connected to a coextensive and coterminous segment of the first partition, said second partition extending longitudinally through the interior chamber and terminating therein, with the first and second partitions, the shell, the second end cap, and the first portal encompassing a first subchamber and a first passage;

a third partition having a first end edge, an opposing second end edge, an outer longitudinal edge and an opposing inner longitudinal edge, said third partition extending substantially radially inward from the shell and connected thereto along said outer longitudinal edge of said third partition and extending substantially perpendicular to the second end cap and connected thereto along said first end edge of said third partition, said inner longitudinal edge of said third partition connected to a coextensive and coterminous segment of the first partition, said third partition extending longitudinally through the interior chamber and terminating therein, with the second and third partitions, the shell, and the first and second end caps encompassing a second subchamber and a second passage, and with the third and first partitions, the shell, the second portal, and the first end cap encompassing a third subchamber, the subchambers and passages situated in fluid communication to form a serpentine channel; and a serpentine tube spatially situated within and extending through the serpentine channel, said serpentine tube having at least one elongated segment extending within each of the subchambers, whereby a primary fluid at a first temperature may be passed through the serpentine channel and a second fluid at a second temperature may be passed through the serpentine tube, thereby creating a temperature differential gradient with the temperature of each fluid approaching thermal equilibrium across the gradient as the fluids are passed through the heat exchanger.

8. The total counterflow heat exchanger of claim 7 wherein the volume of said first subchamber, second subchamber, and third subchamber surrounding said serpentine tube differ.

9. The total counterflow heat exchanger of claim 8 wherein said shell further defines a chimney portal extending through the surface of said shell, with one end of said serpentine tube attached to said shell adjacent to and in fluid communication with said chimney portal.

10. The total counterflow heat exchanger of claim 9 wherein said serpentine tube further defines a combustion chamber region, said combustion region being of generally greater cross sectional diameter than the adjacent region of said serpentine tube communicating with said combustion chamber region.

11. The total counterflow heat exchanger of claim 10 wherein the radial axis of combustion chamber is spatially displaced from the radially axis of the adjacent region of said serpentine tube communicating with said combustion chamber region.

12. The total counterflow heat exchanger of claim 11 wherein said fluids are air and further comprising:

means within said combustion chanber to heat said air;

one or more means to circulate said air within said interior chamber and said serpentine tube; and a housing, situated outside said interior chamber and surrounding said first and second portals, said housing defining at least one housing portal extending through the surface of said housing.

13. A total counterflow heat exchanger comprising:

a shell of generally cylindrical shape open at a first end and a second end, said shell having a surface and defining a three dimensional interior chamber having a generally cylindrical periphery;

a first end cap at the first end of the interior chamber, said first end cap extending substantially radially inward from the periphery of the interior chamber generally perpendicular to the surface of the cylindrical portion of the shell and connected thereto, said first end cap defining a portal region extending through the first end cap;

a second end cap at the second end of the interior chamber opposing the first end cap, said second end cap extending substantially radially inward from the periphery of the interior chamber generally perpendicular to the surface of the cylindrical portion of the shell and connected thereto;

a first partition having a first end edge, an opposing second end edge, and an outer longitudinal edge, said first partition extending substantially radially inward the said shell and connected thereto along said outer longitudinal edge of said first partition, and extending substantially perpendicular to the first end cap and connected thereto along said first end edge of said first partition adjacent the first portal, said first partition extending longitudinally through the interior chamber and connected to the second end cap along said opposing second end edge of said first partition;

a second partition having a first end edge, an opposing second end edge, an outer longitudinal edge, and an opposing inner longitudinal edge, said second partition extending substantially radially inward from the shell and connected thereto along said outer longitudinal edge of said second partition, and extending substantially perpendicular to the first end cap and connected thereto along said first end of said second partition adjacent the first portal, said inner longitudinal edge of said second partition connected to a coextensive and coterminous segment of the first partition, said second partition extending longitudinally through the interior chamber and terminating therein, with the first and second partitions, the shell, the second end cap, and the portal region encompassing a first subchamber and a first passage;

a third partition having a first end edge, an opposing second end edge, an outer longitudinal edge and an opposing inner longitudinal edge, said third partition extending substantially radially inward from the shell and connected thereto along said outer longitudinal edge of said third partition and extending substantially perpendicular to the second end cap and connected thereto along said first end edge of said third partition, said inner longitudinal edge of said third partition connected to a coextensive and coterminous segment of the first partition, said third partition extending longitudinally through the interior chamber and terminating therein, with the second and third partitions, the shell, and the first and second end caps encompassing a second subchamber and a second passage, and with the third and first partitions, the shell, the portal region, and the second end cap encompassing a third subchamber, the subchambers and passages situated in fluid communication to form a serpentine channel; and a serpentine tube spatially situated within and extending through the serpentine channel, and said serpentine tube having at least one elongated segment extending within each of the subchambers, whereby a primary fluid at a first temperature may be passed through the serpentine channel and a secondary fluid at a second temperature may be passed through the serpentine tube, thereby creating a temperature differential gradient with the temperature of each fluid approaching thermal equilibrium across the gradient as the fluids are passed through the heat exchanger.

14. The total counterflow heat exchanger of claim 13 wherein the volume of said first subchamber, second subchamber, and third subchamber surrounding said serpentine tube differ.

15. The total counterflow heat exchanger of claim 14 wherein said shell further defines a chimney portal extending through the surface of said shell, with one end of said serpentine tube attached to said shell adjacent to and in fluid communication with said chimney portal.

16. The total counterflow heat exchanger of claim 15 wherein said serpentine tube further defines a combustion chamber region, said combustion chamber region being of generally greater cross sectional diameter than the adjacent region of said serpentine tube communicating with said combustion chamber region.

17. The total counterflow heat exchanger of claim 16 wherein the radial axis of combustion chamber is spatially displaced from the radially axis of the adjacent region of said serpentine tube communicating with said combustion chamber region.

18. The total counterflow heat exchanger of claim 17 wherein said fluids are air and further comprising:

means within said combustion chamber to heat said air;

one or more means to circulate said air within said interior chamber and said serpentine tube; and a housing, situated outside said interior chamber and surrounding said first and second portals, said housing defining at least one housing portal extending through the surface of said housing.

19. A total counterflow heat exchanger comprising:

a shell of generally cylindrical shape open at a first end and a second end, said shell having a surface and defining a three dimensional interior chamber having a generally cylindrical periphery;

a portal region adjacent the first end of the shell and communicating with the interior chamber;

a first end cap at the first end of the interior chamber, said first end cap extending substantially radially inward from the periphery of the interior chamber generally perpendicular to the surface of the cylindrical portion of the shell and connected thereto;

a second end cap at the second end of the interior chamber opposing the first end cap, said second end cap extending substantially radially inward from the periphery of the interior chamber generally perpendicular to the surface of the cylindrical portion of the shell and connected thereto, the second end cap defining a duct portal extending through the surface of the second end cap;

a first partition having a first end edge, an opposing second end edge, and an outer longitudinal edge, said first partition extending substantially radially inward the said shell and connected thereto along said outer longitudinal edge of said first partition, and extending substantially perpendicular to the first end cap and connected thereto along said first end edge of said first partition adjacent the first portal, said first partition extending longitudinally through the interior chamber and connected to the second end cap along said opposing second end edge of said first partition;

a second partition having a first end edge, an opposing second end edge, an outer longitudinal edge, and an opposing inner longitudinal edge, said second partition extending substantially radially inward from the shell and connected thereto along said outer longitudinal edge of said second partition, and extending substantially perpendicular to the first end cap and connected thereto along said first end edge of said second partition adjacent the first portal, said inner longitudinal edge of said second partition connected to a coextensive and coterminous segment of the first partition, said second partition extending longitudinally through the interior chamber and terminating therein, with the first and second partitions, the shell, the second end cap, the portal region, and the first end cap encompassing a first subchamber and a first passage;

a third partition having a first end edge, an opposing second end edge, an outer longitudinal edge and an opposing inner longitudinal edge, said third partition extending substantially radially inward from the shell and connected thereto along said outer longitudinal edge of said third partition and extending substantially perpendicular to the second end cap and connected thereto along said first end edge of said third partition, said inner longitudinal edge of said third partition connected to a coextensive and coterminous segment of the first partition, said third partition extending longitudinally through the interior chamber and terminating therein, with the second and third partitions, the shell, and the first and second end caps encompassing a second subchamber and a second passage, and with the third and first partitions, the shell, the first and second end caps, and the duct portal encompassing a third subchamber, the subchambers and passages situated in fluid communication to form a serpentine channel; and a serpentine tube spatially situated within and extending through the serpentine channel, said serpentine tube connected in fluid communication with said duct portal, and said serpentine tube having at least one elongated segment extending within each of the subchambers, whereby a primary fluid at a first temperature may be passed through the serpentine channel and a secondary fluid at a second temperature may be passed through the serpentine tube, thereby creating a temperature differential gradient with the temperature of each fluid approaching thermal equilibrium across the gradient as the fluids are passed through the heat exchanger.

20. The toal counterflow heat exchanger of claim 19 wherein the volume of said first subchamber, second subchamber, and third subchamber surrounding said serpentine tube differ.

21. The total counterflow heat exchanger of claim 20 wherein said shell further defines a chimney portal extending through the surface of said shell, with one end of said serpentine tube attached to said shell adjacent to and in fluid communication with said chimney portal.

22. The toal counterflow heat exchanger of claim 21 wherein said serpentine tube further defines a combustion chamber region, said combustion changer region being of generally greater cross sectional diamter than the adjacent region of said serpentine tube communicating with said combustion chamber region.

23. The total counterflow heat exchanger of claim 22 wherein the radial axis of combustion chamber is spatially displaced from the radially axis of the adjacent region of said serpentine tube communicating with said combustion chamber region.

24. The total counterflow heat exchanger of claim 23 wherein said fluids are air and further comprising;

means within said combustion chamber to heat said air;

one or more means to circulate said air within said interior chamber and said serpentine tube; and a housing, situated outside said interior chamber and surrounding said first and second portals, said housing defining at least one housing portal extending through the surface of said housing.

25. A total counterflow heat exchanger comprising:

a shell of generally cylindrical shape open at a first end and a second end, said shell having a surface and defining a three dimensinal interior chamber having a generally cylindrical periphery;

a first end cap at the first end of the interior chamber, said first end cap extending substantially radially inward from the periphery of the interior chamber generally perpendicular to the surface of the cylindrical portion of the shell and connected thereto, said first end cap defining a portal region extending through the first end cap;

a second end cap at the second end of the interior chamber opposing the first end cap, said second end cap extending substantially radially inward from the periphery of the interior chamber generally perpendicular to the surface of the cylindrical portion of the shell and connected thereto;

a first partition having a first end edge, an opposing second end edge, and an outer longitudinal edge, said first partition extending substantially radially inward the said shell and connected thereto along said outer longitudinal edge of said first partition, and extending substantially perpendicular to the first end cap and connected thereto along said first end edge of said first partition adjacent the portal region, said first partition extending longitudinally through the interior chamber and connected to the second end cap along said opposing second end edge of said first partition;

a second partition having a first end edge, an opposing second end edge, an outer longitudinal edge, and an opposing inner longitudinal edge, said second partition extending substantially radially inward from the shell and connected thereto along said outer longitudinal edge of said second partition, and extending substantially perpendicular to the first end cap and connected thereto along said first end edge of said second partition adjacent the portal region, said inner longitudinal edge of said second partition connected to a coextensive and coterminous segment of the first partition, said second partition extending longitudinally through the interior chamber and terminating therein, with the first and second partitions, the shell, the second end cap, and the portal region encompassing a first subchamber and a first passage;

a third partition having a first end edge, an opposing second end edge, an outer longitudinal edge and an opposing inner longitudinal edge, said third partition extending substantially radially inward from the shell and connected thereto along said outer longitudinal edge of said third partition and extending substantially perpendicular to the second end cap and connected thereto along said first end edge of said third partition, said inner longitudinal edge of said third partition connected to a coextensive and coterminous segment of the first partition, said third partition extending longitudinally through the interior chamber and terminating therein, with the second and third partitions, the shell, and the first and second end caps encompassing a second subchamber and a second passage;

a fourth partition having a first end edge, an opposing second end edge, an outer longitudinal edge and an opposing inner longitudinal edge, said fourth partition extending substantially radially inward from the shell and connected thereto along said outer longitudinal edge of said fourth partition and extending substantially perpendicular to the second end cap and connected thereto along said first end edge of said fourth partition; said inner longitudinal edge of said fourth partition connected to a coextensive and coterminous segment of the first partition, said fourth partition extending longitudinally through the interior chamber and terminating adjacent the portal region, with the third and fourth partitions, the shell, the first and second end caps encompassing a third subchamber and a third passage, and with the fourth and first partitions, the shell, the first end cap, and the portal region defining a fourth subchamber, the subchambers and passages situated in fluid communication to form a serpentine channel; and a serpentine tube spatially situated within and extending through the serpentine channel, and said serpentine tube having at least one elongated segment extending within each of the subchambers, whereby a primary fluid at a first temperature may be passed through the serpentine channel and a secondary fluid at a second temperature may be passed through the serpentine tube, thereby creating a temperature differential gradient with the temperature of each fluid approaching thermal equilibrium across the gradient as the fluids are passed through the heat exchanger.

26. The total counterflow heat exchanger of claim 25 wherein the volume of said first subchamber, second subchamber, and third subchamber surrounding said serpentine tube differ.

27. The total counterflow heat exchanger of claim 26 wherein said shell further defines a chimney portal extending through the surface of said shell, with one end of said serpentine tube attached to said shell adjacent to and in fluid communication with said chimney portal.

28. The total counterflow heat exchanger of claim 27 wherein said serpentine tube further defines a combustion chamber region, said combustion chamber region being of generally greater cross sectional diameter than the adjacent region of said serpentine tube communicating with said combustion chamber region.

29. The total counterflow heat exchanger of claim 28 wherein the radial axis of combustion chamber is spatially displaced from the radially axis of the adjacent region of said serpentine tube communicating with said combustion chamber region.

30. The total counterflow heat exchanger of claim 29 wherein said fluids are air and further comprising:

means within said combustion chamber to heat said air;

one or more means to circulate said air within said interior chamber and said serpentine tube; and a housing, situated outside said interior chamber and surrounding said first and second portals, said housing defining at least one housing portal extending through the surface of said housing.

* * * * *